US011623228B2

(12) United States Patent
Lee

(10) Patent No.: US 11,623,228 B2
(45) Date of Patent: Apr. 11, 2023

(54) PISTON FOR CENTRIFUGATION

(71) Applicant: Jun Seok Lee, Busan (KR)

(72) Inventor: Jun Seok Lee, Busan (KR)

( * ) Notice: Subject to any disclaimer, the term of this patent is extended or adjusted under 35 U.S.C. 154(b) by 196 days.

(21) Appl. No.: 16/965,605

(22) PCT Filed: Jan. 23, 2019

(86) PCT No.: PCT/KR2019/000957

§ 371 (c)(1),
(2) Date: Jul. 29, 2020

(87) PCT Pub. No.: WO2019/151705

PCT Pub. Date: Aug. 8, 2019

(65) Prior Publication Data

US 2021/0039113 A1 Feb. 11, 2021

(30) Foreign Application Priority Data

Jan. 30, 2018 (KR) ..... 10-2018-0011502

(51) Int. Cl.

| | |
|---|---|
| ***B04B 1/10*** | (2006.01) |
| ***B04B 11/00*** | (2006.01) |
| ***B65D 83/54*** | (2006.01) |

(52) U.S. Cl.

CPC ..... *B04B 1/10* (2013.01); *B04B 11/00* (2013.01); *B65D 83/54* (2013.01); *B01L 2400/0409* (2013.01)

(58) Field of Classification Search

CPC ..... B04B 1/10; B04B 11/00; B65D 83/54; B01L 2400/0409; B01L 2300/049; B01L 2300/123; B01L 2400/0478; B01L 3/50215; F16K 3/22; F16K 3/24

See application file for complete search history.

(56) References Cited

U.S. PATENT DOCUMENTS 3,058,629 A * 10/1962 Gawthrop ..... B65D 83/425 222/402.2
3,860,150 A * 1/1975 Maier ..... F04B 33/00 222/207
3,897,343 A * 7/1975 Ayres ..... B01L 3/50215 422/918
4,189,385 A * 2/1980 Greenspan ..... F16K 27/0209 422/918

(Continued)

FOREIGN PATENT DOCUMENTS

JP 2596963 4/1997
JP H11314011 11/1999

(Continued)

OTHER PUBLICATIONS

"International Search Report (Form PCT/ISA/210) of PCT/KR2019/000957," dated Apr. 18, 2019, with English translation thereof, pp. 1-6.

*Primary Examiner* — Bob Zadeh
(74) *Attorney, Agent, or Firm* — JCIPRNET

(57) ABSTRACT

A piston for centrifugation according to one embodiment may include: a body; a valve which can move inside the body to the front side and the rear side of the body according to an applied external force; a fluid channel through which a fluid flows from the front side of the body to the rear side of the body; and a valve support for guiding movement of the valve.

7 Claims, 12 Drawing Sheets

(56) References Cited

U.S. PATENT DOCUMENTS

| | | | | | |
|---|---|---|---|---|---|
| 4,202,769 | A * | 5/1980 | Greenspan | B29C 33/444 | 422/918 |
| 4,577,784 | A * | 3/1986 | Brunet | B65D 83/525 | 239/350 |
| 4,892,232 | A * | 1/1990 | Martin | B65D 83/54 | 222/402.2 |
| 4,907,684 | A * | 3/1990 | Breisch | F16D 48/02 | 192/85.28 |
| 5,183,187 | A * | 2/1993 | Martin | B65D 83/525 | 222/335 |
| 5,184,652 | A * | 2/1993 | Fan | A61M 39/26 | 251/149.6 |
| 5,623,974 | A * | 4/1997 | Losenno | B65D 83/42 | 137/511 |
| 2004/0217046 | A1 | 11/2004 | Konrad | | |
| 2005/0109716 | A1 * | 5/2005 | Leach | B01L 3/50215 | 210/787 |
| 2021/0039113 | A1 * | 2/2021 | Lee | B04B 11/00 | |

FOREIGN PATENT DOCUMENTS

| | | |
|---|---|---|
| JP | 2000189407 | 7/2000 |
| JP | 2000199760 | 7/2000 |
| JP | 3137413 | 11/2007 |
| KR | 100228660 | 11/1999 |
| KR | 20060113670 | 11/2006 |
| KR | 20090116957 | 11/2009 |
| KR | 101043227 | 6/2011 |
| KR | 20140031609 | 3/2014 |
| KR | 20140040050 | 4/2014 |
| KR | 101466762 | 11/2014 |
| KR | 20180004720 | 1/2018 |

* cited by examiner

PISTON FOR CENTRIFUGATION

CROSS-REFERENCE TO RELATED APPLICATION

This application is a 371 of international application of PCT application serial no. PCT/KR2019/000957, filed on Jan. 23, 2019, which claims the priority benefit of Korean application no. 10-2018-0011502, filed on Jan. 30, 2018. The entirety of each of the above-mentioned patent applications is hereby incorporated by reference herein and made a part of this specification.

TECHNICAL FIELD

The following example embodiments relate to a piston for centrifugation.

BACKGROUND ART

Since biological tissues obtained by a method such as aspiration or incision contain a large amount of oil, blood, body fluids, and the like, biological tissues are generally centrifugated and used. However, since biological tissues are very small in size, it is impossible to centrifuge the biological tissues using a method according to a related art, there is a risk of contamination due to an exposure of the biological tissues to the air during centrifugation even if centrifugation is possible, or it may be difficult to remove body fluids or oil from the biological tissues. Accordingly, a structure for obtaining pure adipose tissues from which impurities were removed by centrifuging biological tissues (e.g., adipose tissues) is being developed. For example, Korean Patent Application Publication No. 10-2014-0040050 discloses a dual fat suction apparatus.

SUMMARY OF INVENTION

Technical Goals

An aspect is to provide a piston for centrifugation that may easily separate a biological tissue having a predetermined specific gravity and a specific size or a body fluid having a predetermined specific gravity from a mixture of biological tissue, body fluids, and the like, by opening or blocking a fluid channel based on whether an external force is exerted.

Another aspect is to provide a piston for centrifugation that may block a fluid channel extending from a front side of the piston to a rear side of the piston even though an external force is applied to the piston.

Another aspect is to provide a piston for centrifugation that may open a fluid channel extending from a front side of the piston to a rear side of the piston even though an external force is applied to the piston in a centrifugation process.

Technical Solutions

According to an aspect of the present invention, there is provided a piston for centrifugation including a body; a valve movable to a front and a rear of the body within the body, based on whether an external force is exerted; and a valve support configured to guide movement of the valve within the body, the valve support including a fluid channel through which a fluid flows from the front of the body to the rear of the body, wherein the valve moves to the front of the body and the fluid channel is open when the external force is exerted on the valve, and the valve moves to the rear of the body and the fluid channel is blocked when the external force is not exerted on the valve.

The piston may further include an elastic member located between the valve and an inner end portion of the body and configured to elastically support the valve. The elastic member may be compressed when the external force is exerted on the valve, and the elastic member may be extended when the external force is not exerted on the valve.

A weight of the valve may be set based on a magnitude of the external force, an elastic force exerted by the elastic member on the valve, and a friction force between the valve and the valve support.

The valve support may include a guide coaxially aligned with the body, an inlet formed in one end portion of the guide, and an outlet formed on a side of the guide. The fluid channel may extend from the inlet to the outlet along the guide.

The piston may further include a first inner sealing member and a second inner sealing member that are disposed between the valve and the valve support. When the fluid channel is blocked, the first inner sealing member may be located in one portion of the guide based on the outlet, and the second inner sealing member may be located in another portion of the guide based on the outlet.

According to another aspect of the present invention, there is provided a piston for centrifugation including a body having a central axis; a valve having a same axis as the central axis and moving to a front and a rear of the body along the central axis; a valve support including a fluid channel through which a fluid flows from the front of the body to the rear of the body, the valve support being configured to allow the fluid channel to be open or closed based on movement of the valve; and a valve movement limiting mechanism configured to selectively block the fluid channel by selectively limiting movement of the valve to the front of the body or movement of the valve to the rear of the body.

The valve movement limiting mechanism may include a tongue portion formed on an inner surface of the body and extending in a longitudinal direction along the central axis; and a groove formed on an outer surface of the valve in a direction of the central axis and configured to accommodate the tongue portion.

The valve movement limiting mechanism may further include a concave portion formed on a rear surface of the valve; and a projection formed in the valve support. The concave portion and the projection may be snapped to each other.

According to another aspect of the present invention, there is provided a piston for centrifugation including a body having a central axis; a valve having a same axis as the central axis and moving to a front and a rear of the body within the body; and a locking mechanism configured to selectively open or block a fluid channel by selectively locking the valve to the body.

The locking mechanism may further include an engagement element formed to protrude from an inner surface of the body toward a central portion of the body; a first groove formed on an outer surface of the valve in an axial direction of the valve; and a second groove formed on the outer surface of the valve in a circumferential direction of the valve and intersecting the first groove, wherein the engagement element moves along the first groove, is located in the second groove, and then is engaged into the second groove.

Effects

According to example embodiments, a piston for centrifugation may easily separate a biological tissue having a predetermined specific gravity and a specific size or a body fluid having a predetermined specific gravity from a mixture of biological tissue, body fluids, and the like, by opening or blocking a fluid channel based on whether an external force is exerted.

According to example embodiments, a piston for centrifugation may block a fluid channel extending from a front side of the piston to a rear side of the piston even though an external force is applied to the piston.

According to example embodiments, a piston for centrifugation may open a fluid channel extending from a front side of the piston to a rear side of the piston even though an external force is applied to the piston in a centrifugation process.

It should be understood that the effects of the piston for centrifugation according to example embodiments are not limited to the aforementioned effects, and other effects that have not been mentioned can be clearly understood by those skilled in the art from the following description.

BEST MODE FOR CARRYING OUT THE INVENTION

Figure 1:
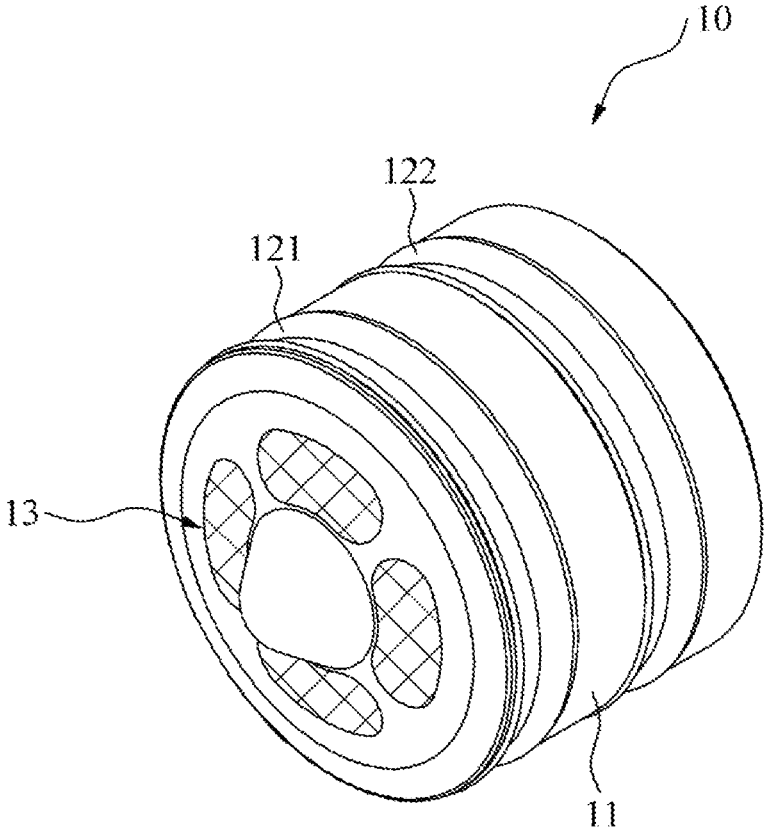
FIG. 1 is a perspective view schematically illustrating a piston for centrifugation according to a first example embodiment.
Figure 2:
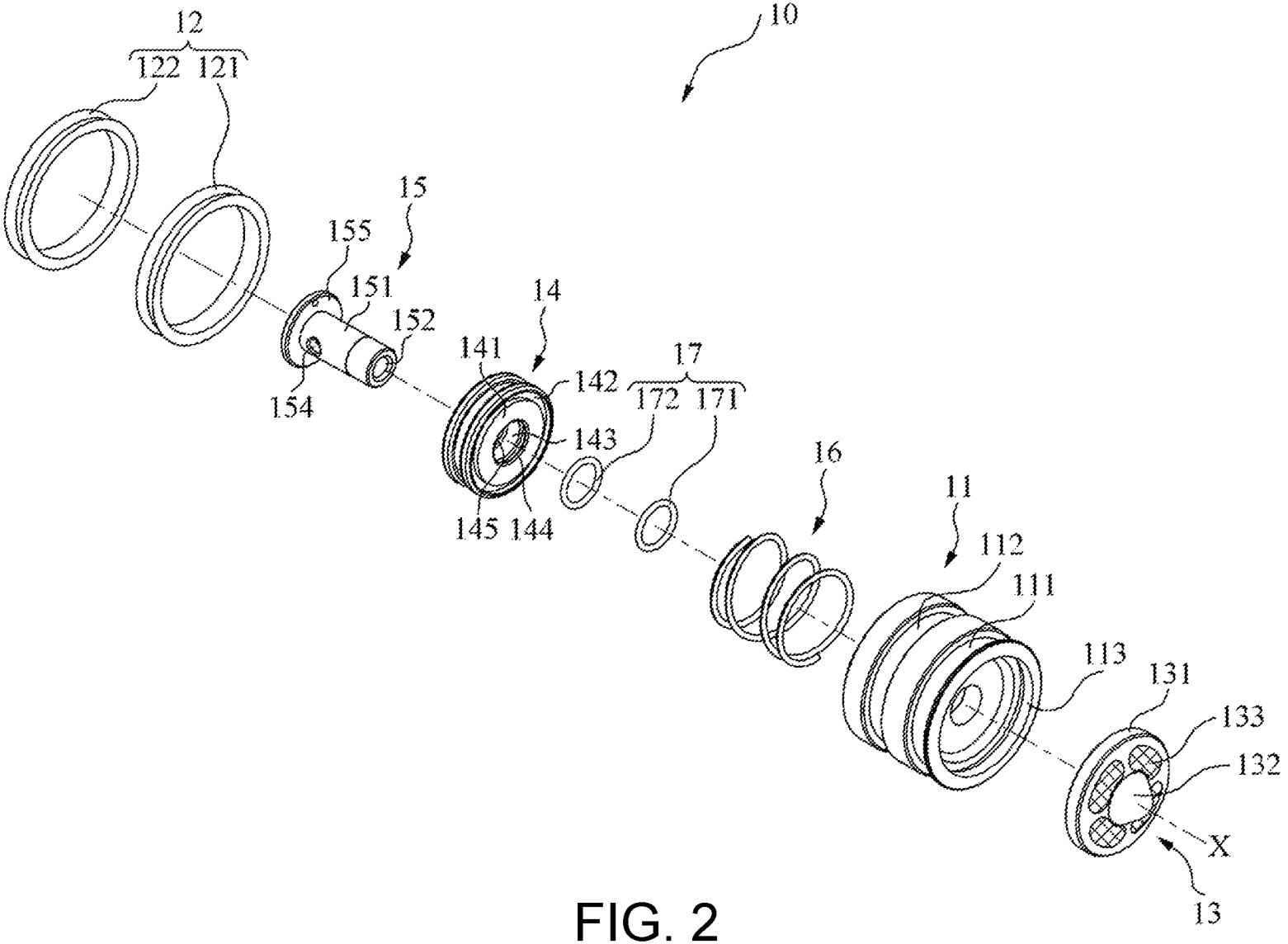
FIG. 2 is an exploded perspective view schematically illustrating components of the piston according to the first example embodiment.
Figure 3:
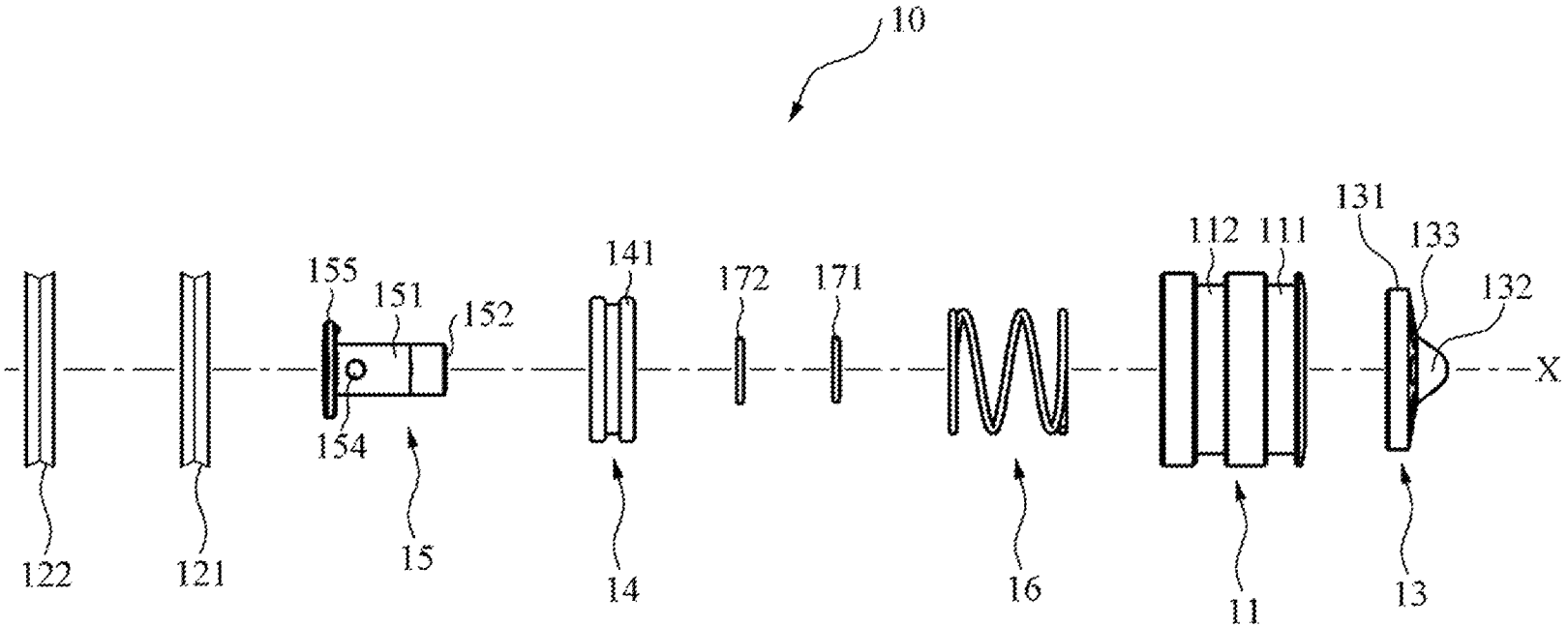
FIG. 3 is an exploded side view schematically illustrating components of the piston according to the first example embodiment.
Figure 4:
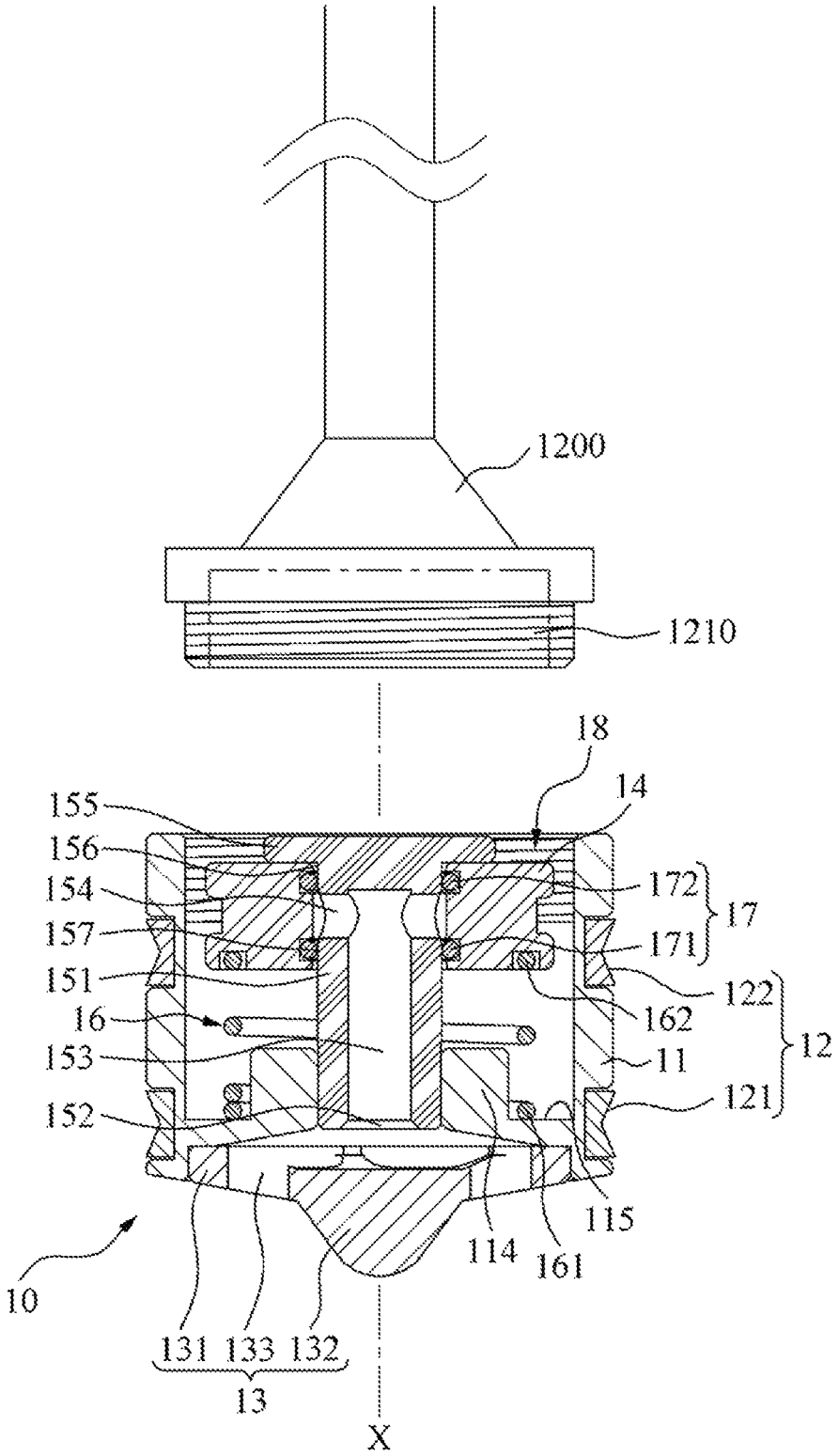
FIG. 4 is a view schematically illustrating a fixing member and a cross section of the piston according to the first example embodiment.

Hereinafter, example embodiments will be described with reference to the accompanying drawings. In the following description, the same elements will be designated by the same reference numerals although they are shown in different drawings. Further, in the following description of the example embodiments, a detailed description of known functions and configurations incorporated herein will be omitted when it may make the subject matter of the example embodiments rather unclear.

Also, the terms "first," "second," "A," "B," "(a)," "(b)," and the like may be used herein to describe components according to example embodiments. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

A component having a common function with a component included in one example embodiment is described using a like name in another example embodiment. Unless otherwise described, description made in one example embodiment may be applicable to another example embodiment and detailed description within a duplicate range is omitted.

The term "front" used herein refers to a front side of a body of a piston for centrifugation, and the term "rear" used herein refers to a rear side of the body of the piston for centrifugation.

The term "positive pressure" used herein indicates that a pressure of the front of the piston and a pressure of the rear of the piston are greater than a pressure outside a container accommodating the piston, and the term "negative pressure" used herein indicates that the pressure of the front of the piston and the pressure of the rear of the piston are less than the pressure outside the container accommodating the piston.

The term "biological tissue" used herein is a tissue extracted from a human body and refers to an adipose tissue, a skin tissue, and the like.

The term "body fluid" used herein refers to blood, free oil, and the like, extracted from a biological tissue.

The term "external force" used herein refers to a force generated by an external driving source applied to a piston. For example, an external force applied to a piston may be mainly a centrifugal force.

Hereinafter, a structure of a piston 10 for centrifugation according to a first example embodiment will be described with reference to FIGS. 1 through 4.

Referring to FIGS. 1 through 4, the piston 10 according to the first example embodiment may separate a biological tissue having a predetermined specific gravity and a specific size, and a body fluid having a predetermined specific gravity from a mixture that contains biological tissues, body fluids, and the like. The piston 10 may include a body 11, an outer sealing portion 12, a filter 13, a valve 14, a valve support 15, an elastic member 16, an inner sealing portion 17, and a coupling portion 18.

Figure 7:
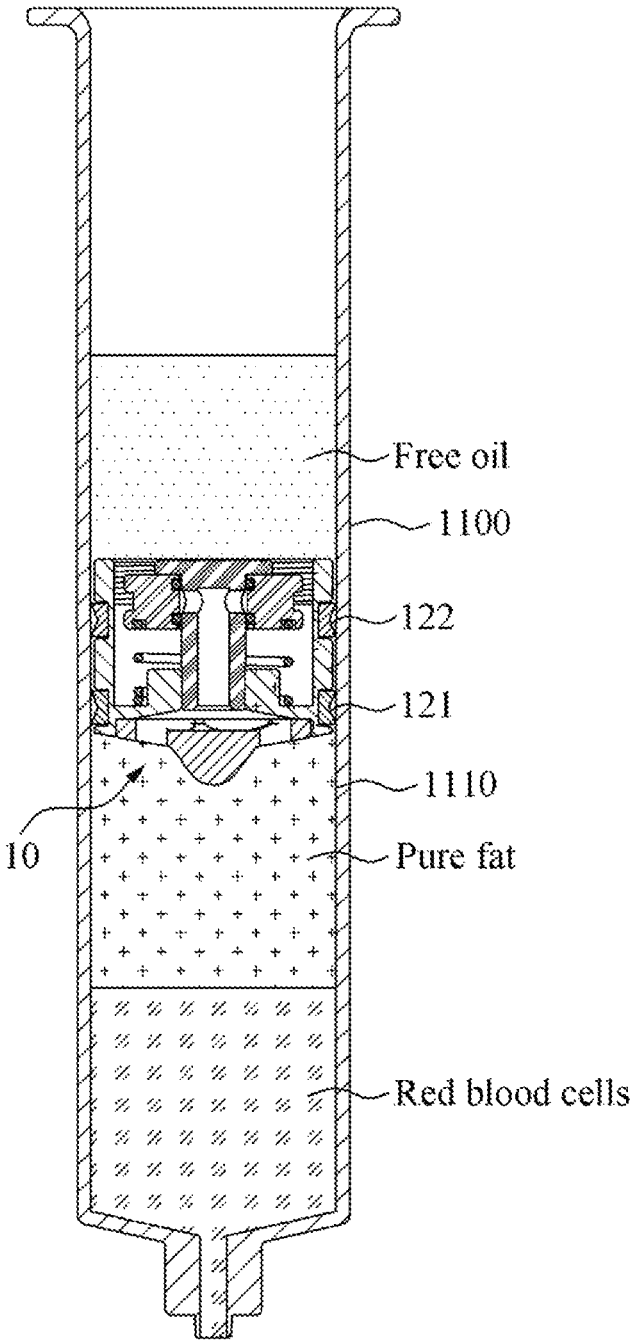
FIG. 7 is a cross-sectional view illustrating a state after centrifugation of adipose tissues in biological tissues is completed by inserting the piston according to the first example embodiment into a container.
Figure 8:
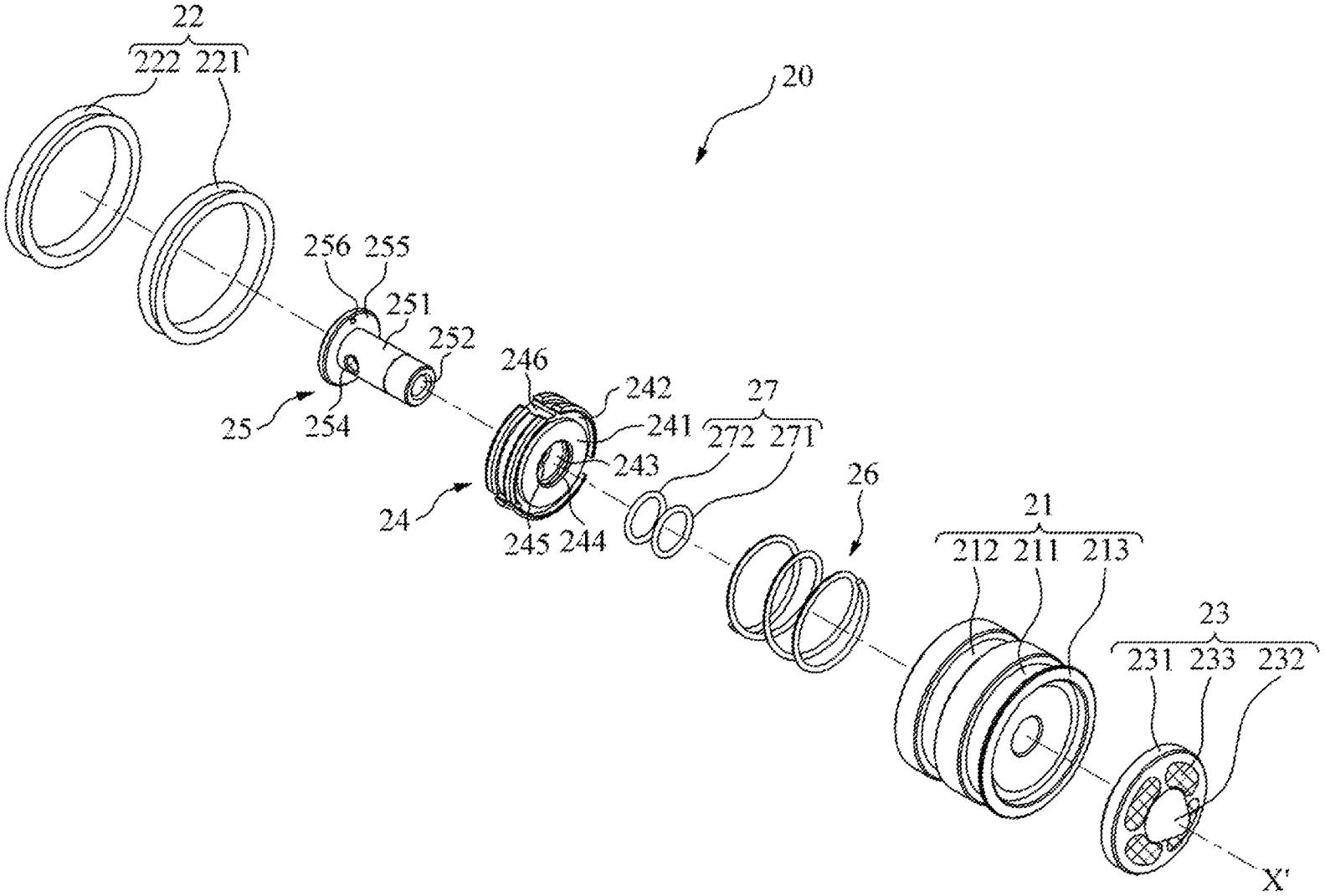
FIG. 8 is an exploded perspective view schematically illustrating a piston for centrifugation according to a second example embodiment.
Figure 9:
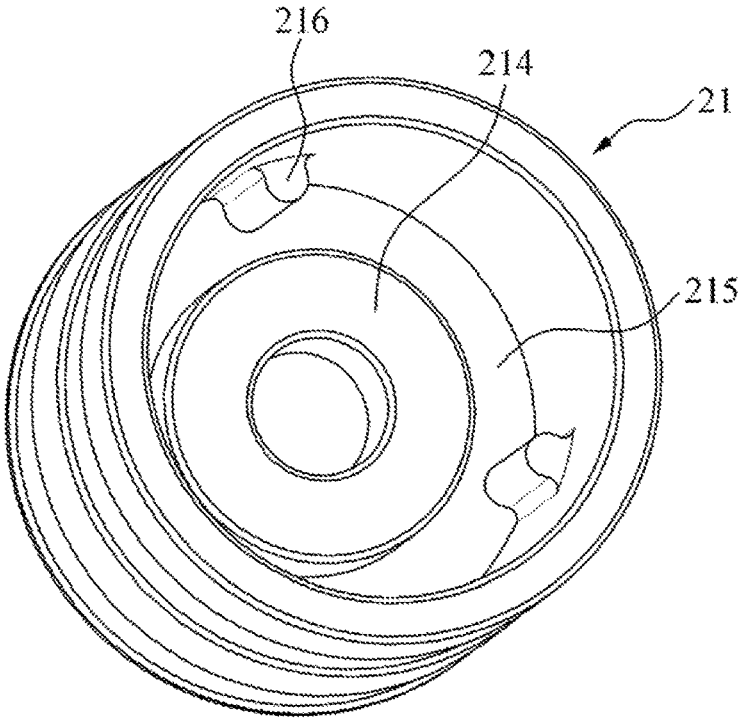
FIG. 9 is a perspective view schematically illustrating an internal configuration of a body of the piston according to the second example embodiment.

The body 11 may move in a longitudinal direction of a container 1100 of FIG. 7 that contains a mixture including biological tissues and body fluids within the container 1100. For example, the container 1100 may be a syringe. When an external force (e.g., a centrifugal force) is exerted on the body 11 disposed in the container 1100, a body fluid that has a relatively low specific gravity and of which component is in a relatively small size in mixtures that contain biological tissues and body fluids and that are in the front of the body 11 may move toward the rear of the body 11, so that the biological tissues and body fluids may be separated. For example, the body 11 may have a shape of a cylinder with a central axis X.

The outer sealing portion 12 may seal between an outer surface of the body 11 and an inner surface 1110 of FIG. 7 of the container 1100 of FIG. 7 to prevent a mixture of biological tissues and body fluids from flowing therebetween. The outer sealing portion 12 may include a first outer sealing member 121 and a second outer sealing member 122. In this example, a first outer recess 111 and a second outer recess 112 may be formed in the outer surface of the body 11, to be coupled to the first outer sealing member 121 and the second outer sealing member 122, respectively. For example, the first outer sealing member 121 and the second outer sealing member 122 may each have a shape of a ring, and a portion of an outer circumference surface of each of the first outer sealing member 121 and the second outer sealing member 122 may be recessed. In this example, an area in which each of the first outer sealing member 121 and the second outer sealing member 122 contacts the inner surface 1110 of FIG. 7 of the container 1100 of FIG. 7 may be reduced, and thus a friction force between the inner surface 1110 of the container 1100 and each of the first outer sealing member 121 and the second outer sealing member 122 may be reduced.

The filter 13 may filter a mixture that moves from the front of the body 11 toward the rear of the body 11. The filter 13 may include a cover 131, a protrusion 132, and a mesh 133. The cover 131 may have a central axis X coaxial with that of the body 11, and may be coupled to a leading edge 113 of the body 11. For example, the cover 131 may have a shape of a circular plate. The protrusion 132 may protrude from a central portion of the cover 131 in a direction of the central axis X of the cover 131. When the body 11 moves toward the front of the body 11 in which a mixture of biological tissues and body fluids is present in response to an external force being applied, a pressure applied to the mixture of the biological tissues and body fluids may increase, and accordingly a number of bubbles contained in the mixture of the biological tissues and body fluids in the front of the body 11 may be reduced. The protrusion 132 may have a streamlined structure. For example, the protrusion 132 may have a convex surface with respect to the cover 131. Based on the above structure, a flow resistance generated when body fluids move along the convex surface of the protrusion 132 may be reduced. The mesh 133 may filter body fluids and biological tissues moving from the front of the body 11 toward the rear of the body 11. The mesh 133 may include pores having a void with a size that is less than a size of a biological tissue to be separated and that is greater than a volume of a body fluid. Thus, a biological tissue having a relatively high specific gravity and a size greater than that of the void and a body fluid having a relatively high specific gravity among biological tissues and body fluids moving from the front of the body 11 toward the rear of the body 11 may remain in the front of the body 11, and a biological tissue having a size less than that of the void and having a specific gravity less than that of the biological tissue remaining in the front of the body 11 and a body fluid having a specific gravity less than that of the body fluid remaining in the front of the body 11 among the biological tissues and body fluids may move toward the rear of the body 11. A plurality of meshes 133 may be installed in the cover 131. For example, a number of meshes 133 may be four. The plurality of meshes 133 may be isolated from each other around the protrusion 132 and installed in the cover 131. For example, the plurality of meshes 133 may be isolated from each other at equal intervals.

The valve 14 may move toward the front of the body 11 or the rear of the body 11 within the body 11, in response to an external force being exerted on the valve 14. The valve 14 may have a central axis X coaxial with that of the body 11. Here, the external force may be a centrifugal force exerted on the valve 14 in a direction of the central axis X toward the front of the body. A structure of the valve 14 will be described in detail below after description of the valve support 15 and the elastic member 16.

The valve support 15 may support the valve 14 to guide movement of the valve 14 or limit movement of the valve 14. The valve support 15 may include a guide 151, an inlet 152, a fluid channel 153, an outlet 154, and a flange 155. The guide 151 may guide movement of the valve 14 within the body 11. The guide 151 may have a shape of a shaft extending in the direction of the central axis X. The guide 151 may have a central axis X coaxial with that of the body 11. Accordingly, the guide 151 may guide the movement of the valve 14 toward the front of the body 11, or the movement of the valve 14 toward the rear of the body 11. The body 11 may include a receiving portion 114 that receives a portion of the guide 151 of the valve support 15. A hole to which a portion of the guide 151 is received may be formed in a center of the receiving portion 114. The inlet 152 may be formed in one end portion of the guide 151, so that fluids may flow into the guide 151 through the inlet 152. The fluid channel 153 may be a fluid passage through which a fluid flows from the front of the body 11 to the rear of the body 11, and may be formed within the guide 151 in a longitudinal direction of the guide 151. The outlet 154 may be formed on a side of the guide 151 so that a fluid may flow out of the guide 151 through the outlet 154. The fluid channel 153 may extend from the inlet 152 to the outlet 154. The flange 155 may limit the movement of the valve 14 to the outside of the body 11.

The flange 155 may be formed on another end portion of the guide 151. For example, the flange 155 may have a shape of a flange. When the valve 14 toward the rear of the body 11 and meets the flange 155, the movement of the valve 14 may be limited to a position of the flange 155 that meets the valve 14. As a result, a deviation of the valve 14 from the body 11 may be prevented.

The receiving portion 114 of the body 11 may enclose a portion of the guide 151 and may extend to an inner central portion of the body 11 in the direction of the central axis X. Accordingly, the valve 14 may move toward the front of the body 11 and meet the receiving portion 114, and thus movement of the valve 14 may be limited to a position of the receiving portion 114 that meets the valve 14. As a result, the valve 14 may move in the longitudinal direction of the guide 151 between the receiving portion 114 of the body 11 and the flange 155 of the valve support 15.

The elastic member 16 may be located between the valve 14 and an inner end portion 115 of the body 11 and may be compressed or extended in the longitudinal direction of the guide 151. For example, the elastic member 16 may be a spring. A first end portion 161 of the elastic member 16 may be located in the inner end portion 115 of the body 11, and a second end portion 162 of the elastic member 16 may be located in a depression 142 of the valve 14, and accordingly the elastic member 16 may elastically support the valve 14 with respect to the body 11. The elastic member 16 may be disposed outside the receiving portion 114 of the body 11.

The inner sealing portion 17 may prevent a flow of a fluid between an inner surface of the valve 14 and an outer surface of the valve support 15. The inner sealing portion 17 may include a first inner sealing member 171 and a second inner sealing member 172 that are disposed between the valve 14 and the valve support 15. The first inner sealing member 171 and the second inner sealing member 172 may contact the guide 151. In an example, movement of the valve 14 may be limited even though an external force is applied, so that the valve 14 may block the outlet 154 of the valve support 15. In this example, the first inner sealing member 171 may be located in a first portion 156 of the side of the guide 151 based on the outlet 154, and the second inner sealing member 172 may be located in a second portion 157 of the side of the guide 151 based on the outlet 154. Here, the first portion 156 and the second portion 157 may be located opposite to each other with respect to the outlet 154. By the above structure, even though a positive pressure or a negative pressure is applied to the container 1100 based on the piston 10, a pressure may be blocked by a friction force between the first inner sealing member 171 and the guide 151 and a friction force between the second inner sealing member 172 and the guide 151, to maintain airtightness between the valve 14 and the guide 151.

The coupling portion 18 may be formed inside the body 11 and may be coupled to a fixing member 1200 that fixes the piston 10. For example, the coupling portion 18 may include an internal thread formed on the inner surface of the body 11 in a rear end of the body 11. In this example, the fixing member 1200 may include an outer thread 1210 formed to be screwed to the internal thread. When a user manually operates the piston 10, the user may move the fixing member 1200 toward the body 11 along the central axis X of the body 11 and may screw the outer thread 1210 of the fixing member 1200 and the internal thread of the coupling portion 18, to fix the valve 14 to the body 11. Accordingly, a flow of a fluid from the front of the body 11 toward the rear of the body 11 may be blocked, and the user may manually operate the piston 10.

Hereinafter, the structure of the valve 14 will be further described together with a coupling relationship among the valve 14, the valve support 15, the elastic member 16 and the inner sealing portion 17.

The valve 14 may include a valve body 141, the depression 142, a hollow 143, a first inner recess 144, and a second inner recess 145. The valve body 141 may have a central axis X coaxial with that of the body 11. For example, the valve body 141 may have a cylindrical shape. The depression 142 may be formed in a circumferential direction of the valve body 141 toward an inner central portion of the valve body 141. The second end portion 162 of the elastic member 16 may be located in the depression 142, so that the valve 14 may be elastically supported by the elastic member 16. The hollow 143 may be formed in the valve body 141 to penetrate a central portion of the valve body 141 from the front of the valve body 141 to the rear of the valve body 141. The guide 151 of the valve support 15 may be inserted into the hollow 143. Accordingly, the valve body 141 may move in the longitudinal direction of the guide 151 in a state in which the guide 151 is inserted into the hollow 143. The first inner recess 144 and the second inner recess 145 may be formed in an inner surface of the valve body 141, and may be coupled to the first inner sealing member 171 and the second inner sealing member 172, respectively.

The valve 14 may have a set weight. The weight of the valve 14 may be set based on a magnitude of an external force, an elastic force applied by the elastic member 16 to the valve 14, a friction force between the valve 14 and the valve support 15, and the like. Here, a magnitude of the external force applied to the valve 14, and the friction force between the valve 14 and the valve support 15 may depend on the weight of the valve 14. For example, when the valve 14 is moved to the front of the body 11, the magnitude of the external force applied to the valve 14 may be set to be greater than a sum of a magnitude of an elastic force exerted on the valve 14 and a magnitude of the friction force between the valve 14 and the valve support 15. When the valve 14 is moved to the rear of the body 11, the magnitude of the external force applied to the valve 14 may be set to be less than the sum of the magnitude of the elastic force exerted on the valve 14 and the magnitude of the friction force between the valve 14 and the valve support 15.

An operation of the piston 10 according to the first example embodiment will be described below with reference to FIGS. 5 through 7.

Figure 5:
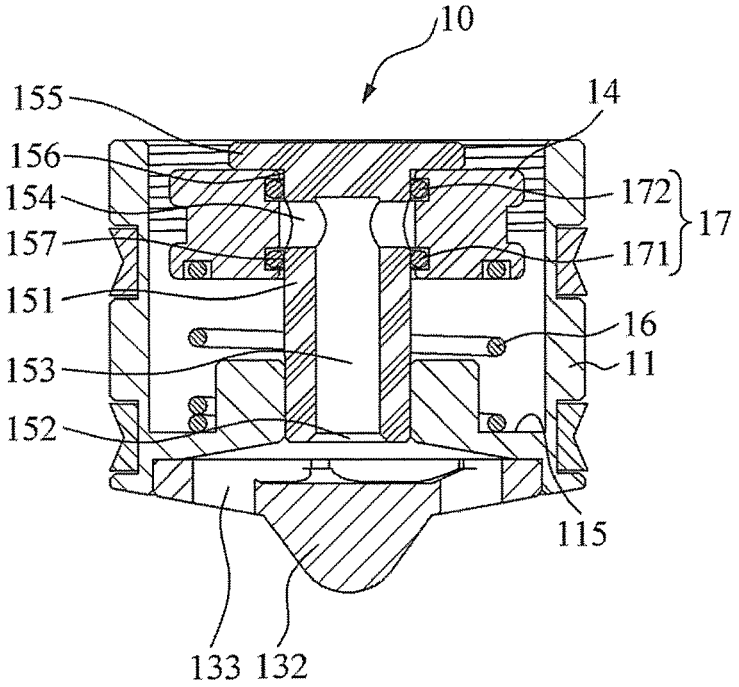
FIG. 5 is a cross-sectional view illustrating an operation of the piston when an external force is not exerted on the piston according to the first example embodiment.

FIG. 5 illustrates a force equilibrium state in which an external force is not exerted on the piston 10. Since the elastic member 16 applies an elastic force to the valve 14, the valve 14 may attempt to move to the rear of the body 11 in a direction away from the inner end portion 115 of the body 11. Here, the flange 155 may limit movement of the valve 14, to prevent the valve 14 from deviating from the body 11.

In the above state, the valve 14 may block the outlet 154, to prevent a biological tissue that has a relatively low specific gravity and that is relatively small in size and a body fluid having a relatively low specific gravity, in mixtures that contain biological tissues and body fluids and that are in the front of the body 11, from being filtered by the mesh 133, from entering the inlet 152, and from flowing to the rear of the body 11 along the fluid channel 153. Fluid sealing between the valve 14 and the valve support 15 may be achieved by the first inner sealing member 171 and the second inner sealing member 172 of the inner sealing portion 17.

Figure 6:
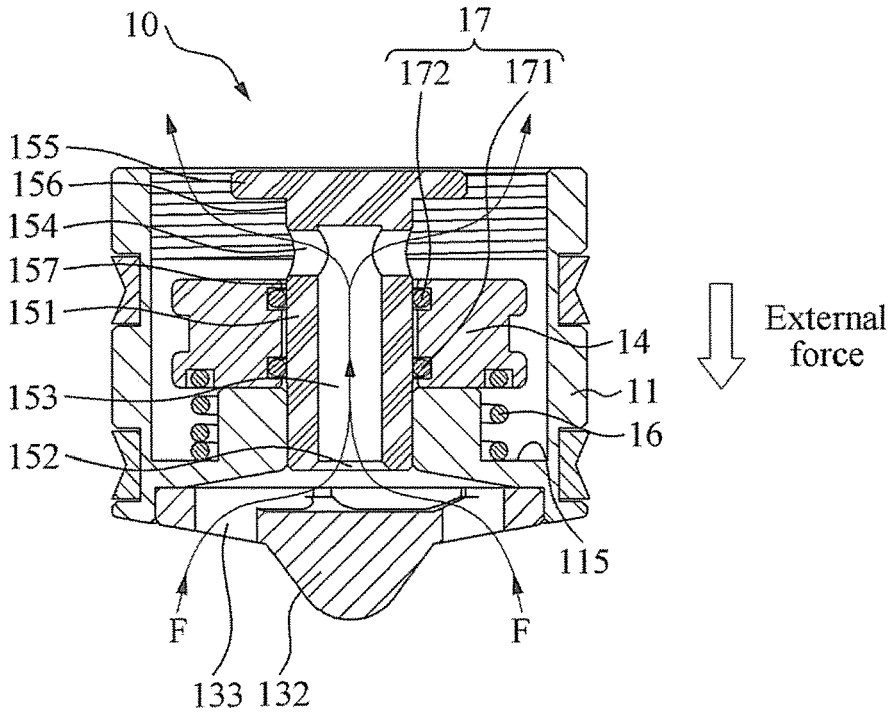
FIG. 6 is a cross-sectional view illustrating an operation of the piston when an external force is exerted on the piston according to the first example embodiment.

FIG. 6 illustrates a state in which an external force, i.e., a centrifugal force is exerted on the piston 10 when a center of rotation of centrifugation is in the rear of the body 11. When the center of the rotation of the centrifugation is in the rear of the body 11, a centrifugal force may be exerted on the piston 10 of FIG. 5 due to the centrifugation, as shown in FIG. 6. When a magnitude of the centrifugal force is greater than a sum of a magnitude of an elastic force applied to the valve 14 and a magnitude of a friction force between the valve support 15 and the inner sealing portion 17, the valve 14 may move toward the front of the body 11 in the longitudinal direction of the valve support 15, and the outlet 154 may be open. Accordingly, a fluid entering the inlet 152 and flowing along the fluid channel 153 may flow to the rear of the body 11 through the outlet 154. When the centrifugation is terminated and when the centrifugal force is not applied to the piston 10 anymore, the valve 14 may move to the rear of the body 11 due to the elastic force applied to the valve 14 and may stop by the flange 155, and the outlet 154 may be blocked by the valve 14 as shown in the state of the piston 10 of FIG. 5.

FIG. 7 illustrates a state in which blood, an aqueous solution, and pure adipose tissues remain in the front of the piston 10 and only free oil remains in the rear of the piston 10, based on the piston 10 disposed in the container 1100 after centrifugation of adipose tissues in biological tissues is completed. When the centrifugation is completed, a user may obtain only free oil as needed. For example, when a user desires to obtain a pure adipose tissue, the user may remove free oil, and may move the piston 10 to the front of the container 1100 to allow blood and an aqueous solution to flow to the front of the container 1100, thereby obtaining the remaining pure adipose tissue.

For example, when a mixture of biological tissues, blood and body fluids is in the front of the piston 10 within the container 1100, and when centrifugation is performed at a set revolutions per minute (RPM), the mixture may be separated and accelerated based on a specific gravity by a centrifugal force. In this example, when a magnitude of the centrifugal force is greater than a magnitude of a specific centrifugal force, the valve 14 may move in a direction in which the centrifugal force is exerted, against an elastic force exerted on the valve 14 and a friction force between the valve support 15 and the inner sealing portion 17, and the outlet 154 may be open. Thus, a biological tissue having a relatively low specific gravity and a size less than that of the void of the mesh 133 and a body fluid having a relatively low specific gravity among the biological tissues and body fluids separated by the centrifugation may move toward the rear of the body 11, and the piston 10 may move in the direction in which the centrifugal force is exerted. As a result, based on the piston 10, a biological tissue that has a relatively low specific gravity and that is relatively small in size, and a body fluid having a relatively low specific gravity may be located in the rear of the piston 10, and a biological tissue that has a relatively high specific gravity and that is relatively large in size, and a body fluid having a relatively high specific gravity may be located in the front of the piston 10. When the centrifugation ends, the valve 14 may move toward the rear of the body 11 by the elastic force applied to the valve 14, and the outlet 154 may be blocked. Subsequently, a desired biological tissue and body fluid among the biological tissues and body fluids separated in the container 1100 may be separately collected.

Hereinafter, a structure and an operating method of a piston 20 for centrifugation according to a second example embodiment will be described with reference to FIGS. 8 through 13.

Referring to FIGS. 8 through 13, the piston 20 according to the second example embodiment may include a body 21 having a central axis X' and including a first outer recess 211, a second outer recess 212, a leading edge 213, a receiving portion 214 and an inner end portion 215, an outer sealing portion 22 including a first outer sealing member 221 and a second outer sealing member 222, a filter 23 including a cover 231, a protrusion 232 and a mesh 233, a valve 24 including a valve body 241, a depression 242, a hollow 243, a first inner recess 244 and a second inner recess 245, a valve support 25 including a guide 251, an inlet 252, a fluid channel 253, an outlet 254 and a flange 255, an elastic member 26, an inner sealing portion 27 including a first inner sealing member 271 and a second inner sealing member 272, and a coupling portion 28.

The piston 20 according to the second example embodiment may include a valve movement limiting mechanism configured to selectively limit movement of the valve 24 and to block the fluid channel 253 even though an external force is applied to the piston 20. The valve movement limiting mechanism may include a tongue portion 216 and a groove 246. The tongue portion 216 may be formed on an inner surface of the body 21 and extend in a longitudinal direction along the central axis X'. The groove 246 may be formed on an outer surface of the valve 24 in a direction of the central axis X'. A width of the groove 246 may be greater than or substantially the same as a width of the tongue portion 216 so that the tongue portion 216 may be accommodated in the groove 246.

Figure 10:
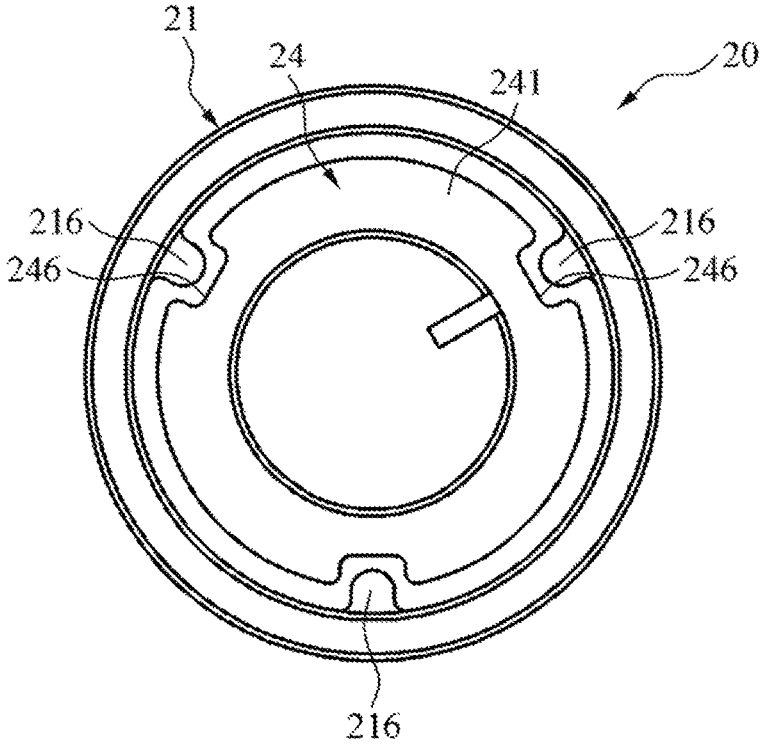
FIG. 10 is a view illustrating a first state in which a valve of the piston according to the second example embodiment is not supported by a tongue portion.
Figure 11:
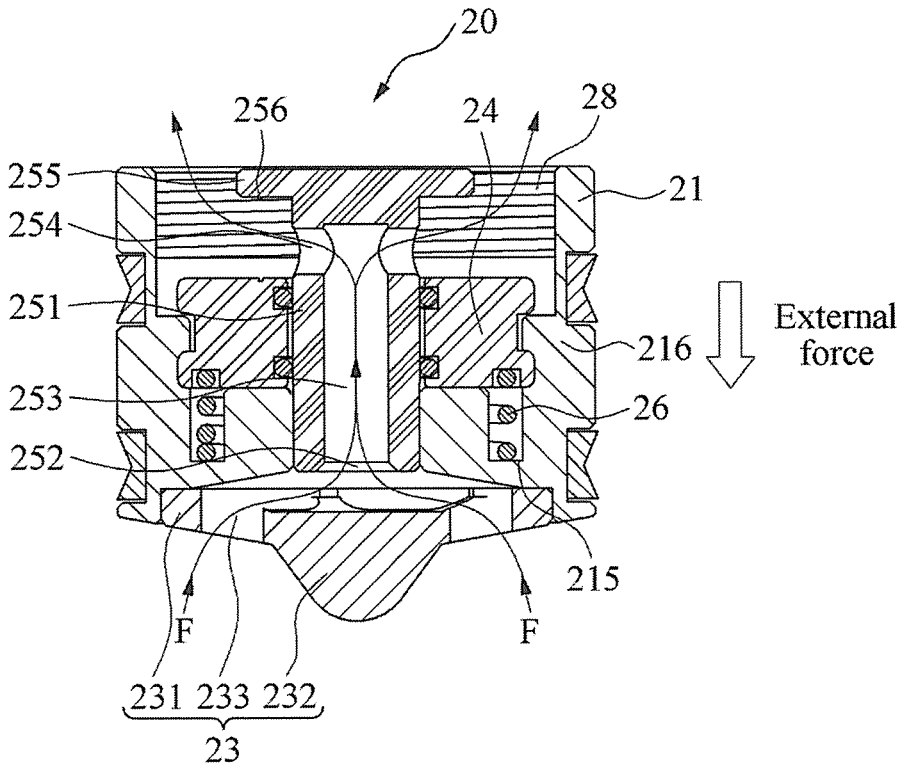
FIG. 11 is a cross-sectional view of the piston according to the second example embodiment in a state in which an external force is exerted when the valve of the piston according to the second example embodiment is not supported by the tongue portion.

FIGS. 10 and 11 illustrate a first state in which the tongue portion 216 and the groove 246 are aligned to each other. Since in the first state, the tongue portion 216 does not limit movement of the valve 24 when an external force is applied to the piston 20, the valve 24 may not be fixed to the valve support 25 and may move to the front and the rear of the body 21 along the guide 251, and both opening and closing of the fluid channel 253 may be enabled. While the valve 24 is moving to the front and the rear of the body 21, the groove 246 may be guided by the tongue portion 216 to move along the tongue portion 216.

Figure 12:
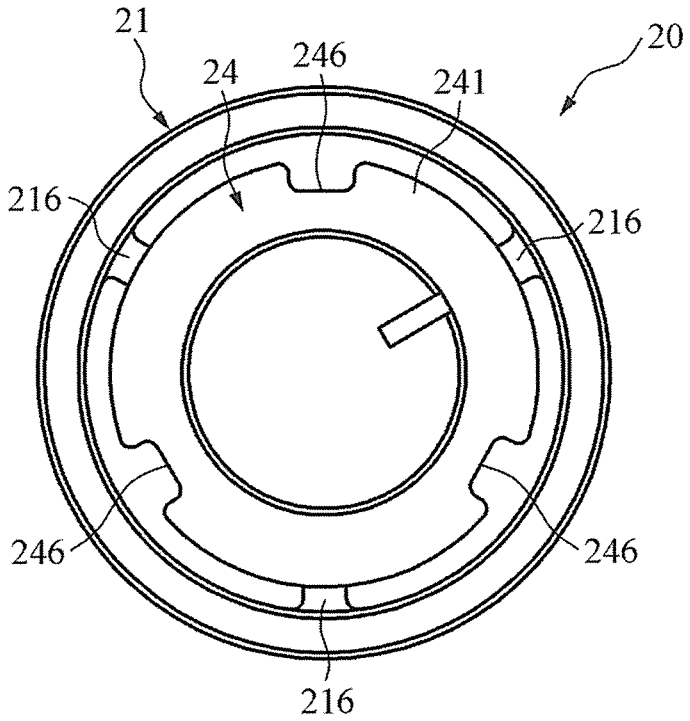
FIG. 12 is a view illustrating a second state in which the valve of the piston according to the second example embodiment is supported by the tongue portion.
Figure 13:
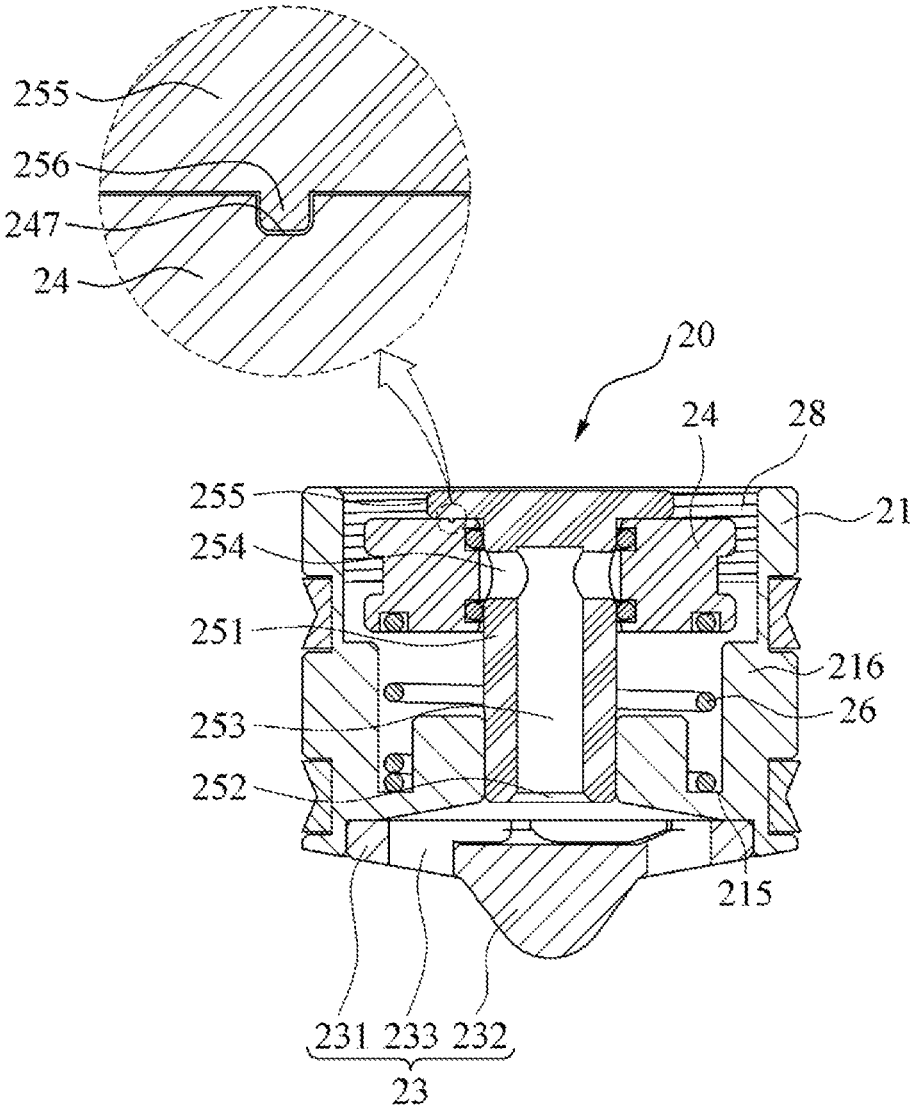
FIG. 13 is a cross-sectional view of the piston according to the second example embodiment in a state in which the valve of the piston according to the second example embodiment is supported by the tongue portion.

FIGS. 12 and 13 illustrate a second state in which the tongue portion 216 and the groove 246 are misaligned to each other. Since in the second state, the tongue portion 216 may limit movement of the valve 24 even though an external force is applied to the piston 20, the valve 24 may not move along the valve support 25, so that a state in which the fluid channel 253 is blocked may be maintained.

In an example embodiment, the valve movement limiting mechanism may further include a projection 256 and a concave portion 247 that are snapped to each other. The projection 256 may be formed in the flange 255 to protrude from an outer surface of the flange 255. The concave portion 247 may be formed on a rear surface of the valve 24 to be recessed from the rear surface of the valve 24 into the valve 24. For example, a plurality of projections 256 and a plurality of concave portions 247 may be formed. When the tongue portion 216 limits movement of the valve 24, the projection 256 formed in the flange 255 may be snapped into the concave portion 247 formed in the valve 24. Based on the above structure, to change a state of the piston 20 from the second state to the first state or from the first state to the second state, a user may easily verify whether the tongue portion 216 and the groove 246 are aligned or misaligned based on whether the projection 256 and the concave portion 247 are snapped.

Hereinafter, a structure and an operating method of a piston 30 for centrifugation according to a third example embodiment will be described with reference to FIGS. 14 through 16.

Figure 14:
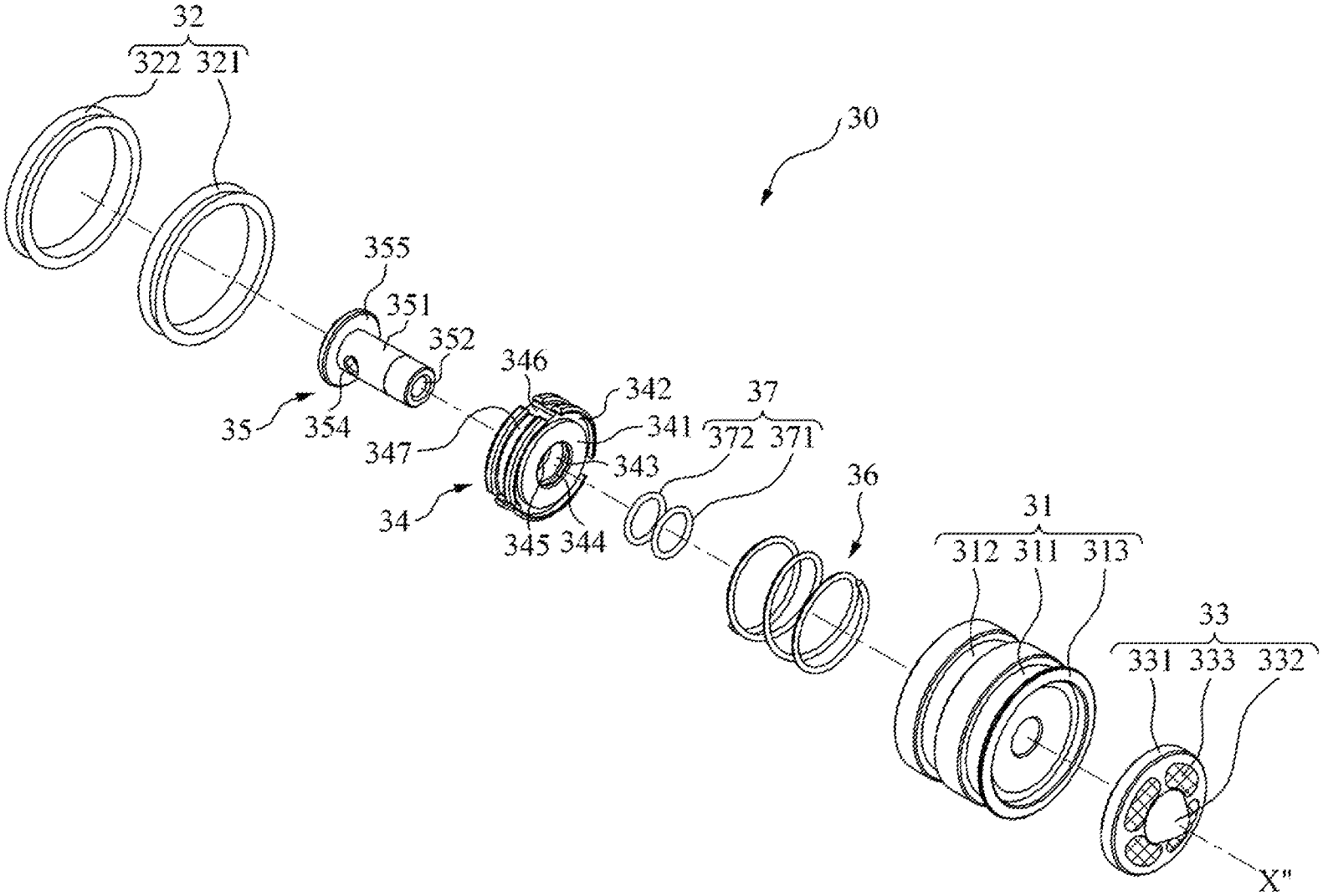
FIG. 14 is an exploded perspective view schematically illustrating a piston for centrifugation according to a third example embodiment.
Figure 15:
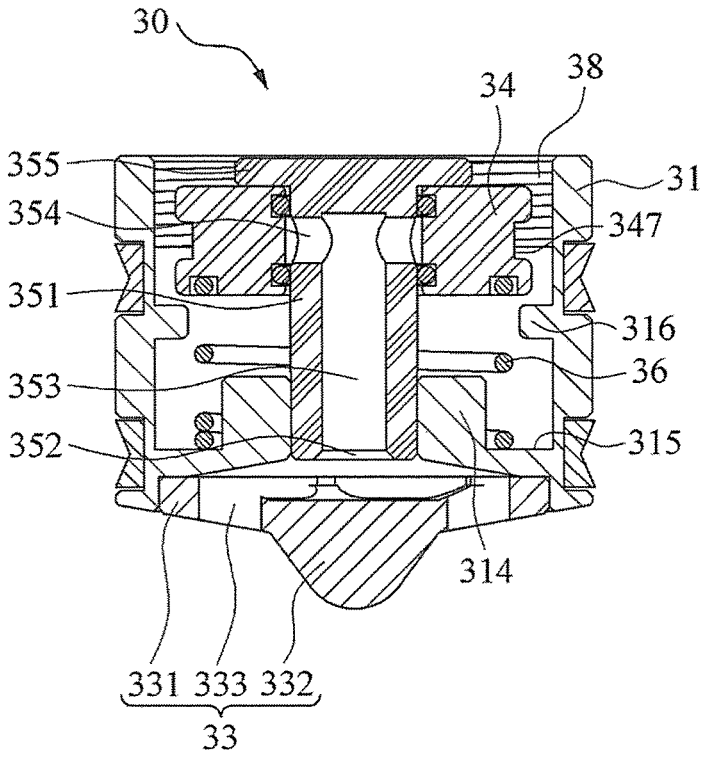
FIG. 15 is a cross-sectional view of the piston according to the third example embodiment in a state in which a valve of the piston according to the third example embodiment is not fixed to a body.
Figure 16:
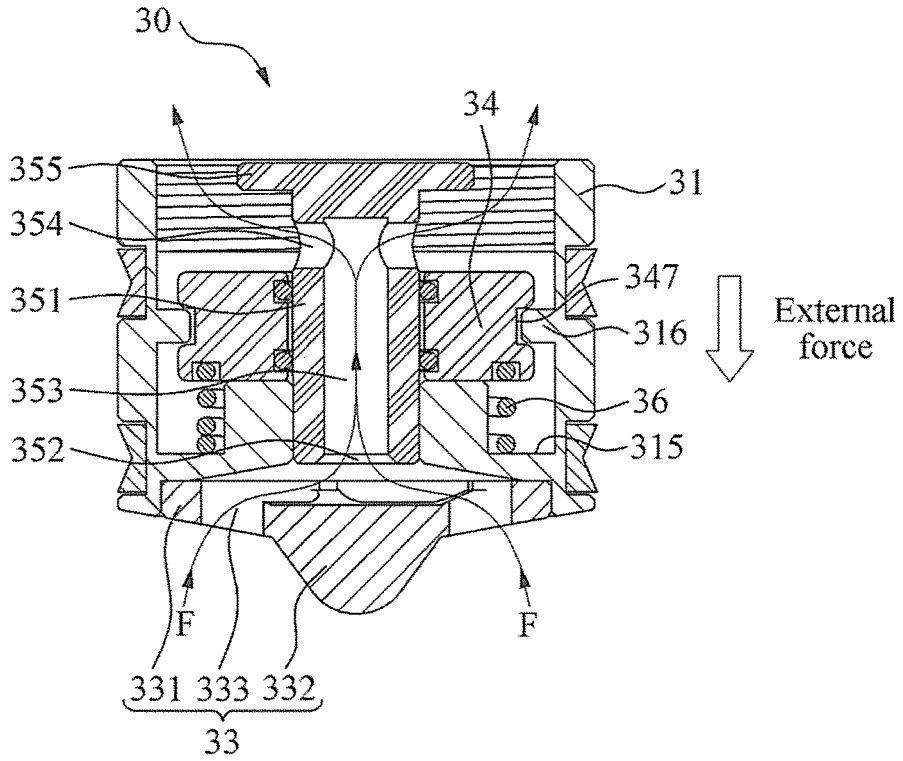
FIG. 16 is a cross-sectional view of the piston according to the third example embodiment in a state in which the valve of the piston according to the third example embodiment is fixed to the body.

Referring to FIGS. 14 through 16, the piston 30 according to the third example embodiment may include a body 31 having a central axis X" and including a first outer recess 311, a second outer recess 312, a leading edge 313, a receiving portion 314 and an inner end portion 315, an outer sealing portion 32 including a first outer sealing member 321 and a second outer sealing member 322, a filter 33 including a cover 331, a protrusion 332 and a mesh 333, a valve 34 including a valve body 341, a depression 342, a hollow 343, a first inner recess 344 and a second inner recess 345, a valve support 35 including a guide 351, an inlet 352, a fluid channel 353, an outlet 354 and a flange 355, an elastic member 36, an inner sealing portion 37 including a first inner sealing member 371 and a second inner sealing member 372, and a coupling portion 38.

The piston 30 according to the third example embodiment may include a locking mechanism configured to selectively open or block the fluid channel 353 by selectively locking the valve 34 to the body 31. In this example, the valve 34 may have a cylindrical shape. The locking mechanism may include an engagement element 316, a first groove 346 and a second groove 347. The engagement element 316 may be formed to protrude from an inner surface of the body 31 toward a central portion of the body 31. The first groove 346 may be formed on an outer surface of the valve 34 in an axial direction of the valve 34. The second groove may be formed on the outer surface of the valve 34 in a circumferential direction of the valve 34. The first groove 346 and the second groove 347 may intersect each other. For example, a size of the engagement element 316 may be less than or substantially the same as a size of the first groove 346 and a size of the second groove 347, so that the engagement element 316 may be received to each of the first groove 346 and the second groove 347.

When an external force is applied to the valve 34 in a state in which the engagement element 316 is aligned with the first groove 346, the engagement element 316 may move along the first groove 346, the valve 34 may freely move to the front and the rear of the body 31 along the guide 351, and both opening and closing of the fluid channel 353 may be possible.

When a user moves the valve 34 to the front of the piston 30 by applying an external force to the valve 34 through a separate operation and when the valve 30 comes into contact with the receiving portion 314, the valve 34 may be rotated about the central axis X". In this example, when the engagement element 316 moves along the first groove 346, the engagement element 316 may enter the second groove 347 intersecting the first groove 346. The engagement element 316 entering the second groove 347 may move along the second groove 347 to be engaged into the second groove 347. In the above state, movement of the valve 34 may be limited by the engagement element 316 locked into the second groove 347 even though an external force is applied to the valve 34 in a centrifugation process, and accordingly a state in which the valve 34 is fixed to the body 31 may be maintained. Thus, a state of the fluid channel 353 being open may be maintained.

While a few example embodiments have been shown and described with reference to the accompanying drawings, it will be apparent to those skilled in the art that various modifications and variations can be made from the foregoing descriptions. For example, adequate effects may be achieved even if the foregoing processes and methods are carried out in different order than described above, and/or the aforementioned elements, such as systems, structures, devices, or circuits are combined or coupled in different forms and modes than as described above or be substituted or switched with other components or equivalents.

What is claimed is:

1. A piston for centrifugation comprising:

a body;

a valve movable to a front and a rear of the body within the body, based on whether a centrifugal force is exerted; and a valve support configured to guide movement of the valve within the body, the valve support comprising a fluid channel through which a fluid flows from the front of the body to the rear of the body, wherein the valve moves relatively to the valve support to the front of the body and the fluid channel is open when the centrifugal force is exerted on the valve, and the valve moves relatively to the valve support to the rear of the body and the fluid channel is blocked when the centrifugal force is not exerted on the valve, wherein the valve support comprises:

a guide coaxially aligned with the body;

an inlet formed in one end portion of the guide; and an outlet formed on a side of the guide, and the fluid channel extends from the inlet to the outlet along the guide.

2. The piston of claim 1, further comprising:

an elastic member located between the valve and an inner end portion of the body and configured to elastically support the valve, wherein the elastic member is compressed when the centrifugal force is exerted on the valve, and the elastic member is extended when the centrifugal force is not exerted on the valve.

3. The piston of claim 2, wherein a weight of the valve is set based on a magnitude of the centrifugal force, an elastic force exerted by the elastic member on the valve, and a friction force between the valve and the valve support.

4. The piston of claim 1, further comprising:

a first inner sealing member and a second inner sealing member that are disposed between the valve and the valve support, wherein the first inner sealing member is located in one portion of the guide based on the outlet, and the second inner sealing member is located in another portion of the guide based on the outlet, when the fluid channel is blocked.

5. A piston for centrifugation comprising:

a body having a central axis;

a valve having a same axis as the central axis and moving to a front and a rear of the body along the central axis;

a valve support comprising a fluid channel through which a fluid flows from the front of the body to the rear of the body, the valve support being configured to allow the fluid channel to be open or closed based on movement of the valve; and a valve movement limiting mechanism configured to selectively block the fluid channel by selectively limiting movement of the valve relative to the valve support to the front of the body or movement of the valve relative to the valve support to the rear of the body, wherein the valve movement limiting mechanism comprises:

a tongue portion formed on an inner surface of the body and extending in a longitudinal direction along the central axis; and a groove formed on an outer surface of the valve in a direction of the central axis and configured to accommodate the tongue portion.

6. The piston of claim 5, wherein the valve movement limiting mechanism further comprises:

a concave portion formed on a rear surface of the valve; and a projection formed in the valve support, wherein the concave portion and the projection are snapped to each other.

7. A piston for centrifugation comprising:

a body having a central axis;

a valve having a same axis as the central axis and moving to a front and a rear of the body within the body; and a locking mechanism configured to selectively open or block a fluid channel by selectively locking the valve to the body, wherein the locking mechanism comprises:

an engagement element formed to protrude from an inner surface of the body toward a central portion of the body;

a first groove formed on an outer surface of the valve in an axial direction of the valve; and a second groove formed on the outer surface of the valve in a circumferential direction of the valve and intersecting the first groove, wherein the engagement element moves along the first groove, is located in the second groove, and then is engaged into the second groove.

* * * * *